US006270431B1

(12) United States Patent
Martin

(10) Patent No.: US 6,270,431 B1
(45) **Date of Patent: *Aug. 7, 2001**

(54) CONTROL GRID FOR TABLE TENNIS SCOREKEEPING DEVICE WITH AUDIO AND VISUAL DISPLAY

(76) Inventor: Steven D. Martin, 628 Enos Ct., Santa Clara, CA (US) 95051

( * ) Notice: Subject to any disclaimer, the term of this patent is extended or adjusted under 35 U.S.C. 154(b) by 0 days.

This patent is subject to a terminal disclaimer.

(21) Appl. No.: 09/481,373

(22) Filed: Jan. 10, 2000

Related U.S. Application Data

(63) Continuation-in-part of application No. 08/837,531, filed on Apr. 21, 1997, now Pat. No. 6,012,995.

(51) Int. Cl.[7] ..... A63B 69/00

(52) U.S. Cl. ..... 473/459; 473/475; 340/323 R; 377/5

(58) Field of Search ..... 473/459, 461, 473/463, 464, 71, 224, 407, 438, 446, 447, 451, 524; 273/371, 376; 463/1, 3, 4, 47; 340/323 R; 377/4, 5

(56) References Cited

U.S. PATENT DOCUMENTS 4,097,855 * 6/1978 Salvo ..... 340/323 R
4,237,372 * 12/1980 Zevgolis et al. ..... 377/5
4,491,954 * 1/1985 Genuit ..... 377/5
4,974,857 * 12/1990 Beall et al. ..... 273/371
5,127,044 * 6/1992 Bonito et al. ..... 340/323 R
5,134,565 * 7/1992 Herbertz ..... 340/323 R
5,198,976 * 3/1993 Form et al. ..... 473/71
5,300,920 * 4/1994 Caselli et al. ..... 340/323 R
5,358,253 * 10/1994 Chen ..... 273/344
5,553,861 * 9/1996 Pan ..... 273/371
5,574,422 * 11/1996 Martin ..... 340/323 R
5,672,131 * 9/1997 Osborne et al. ..... 473/527
5,733,210 * 3/1998 Yiu ..... 473/475
6,012,995 * 1/2000 Martin ..... 473/459

* cited by examiner

*Primary Examiner*—Jeanette Chapman
*Assistant Examiner*—Mitra Aryanpour
(74) *Attorney, Agent, or Firm*—The Kline Law Firm

(57) ABSTRACT

A control grid for an automated scorekeeping device for table tennis or ping pong includes a voice recorder that is used to announce the score before each serve of the game. The scorekeeping device further includes optional visual displays. The scorekeeping device is actuated by means of a grid system attached to the ends of the table. The grid is activated by the players' touching the grid with a conductive strip affixed to the end of their paddles. The scorekeeper can be adjusted manually to correct mistakes, and can be used in multiple modes.

7 Claims, 13 Drawing Sheets

FIGURE 1
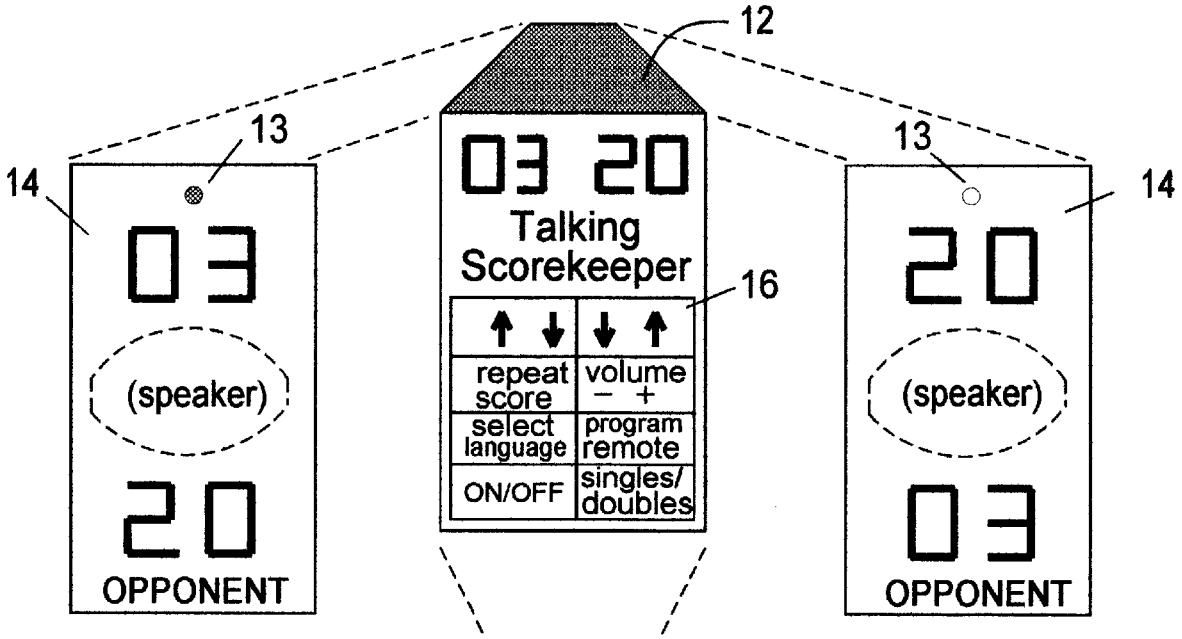
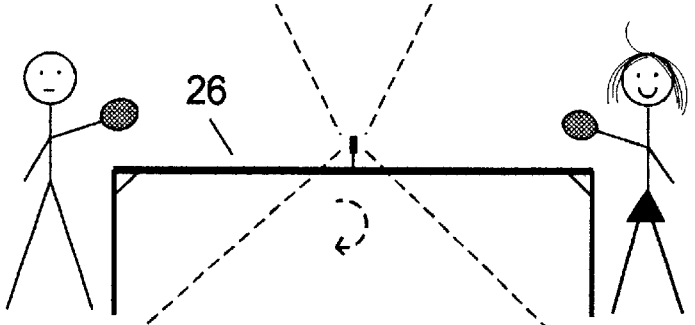
FIGURE 2
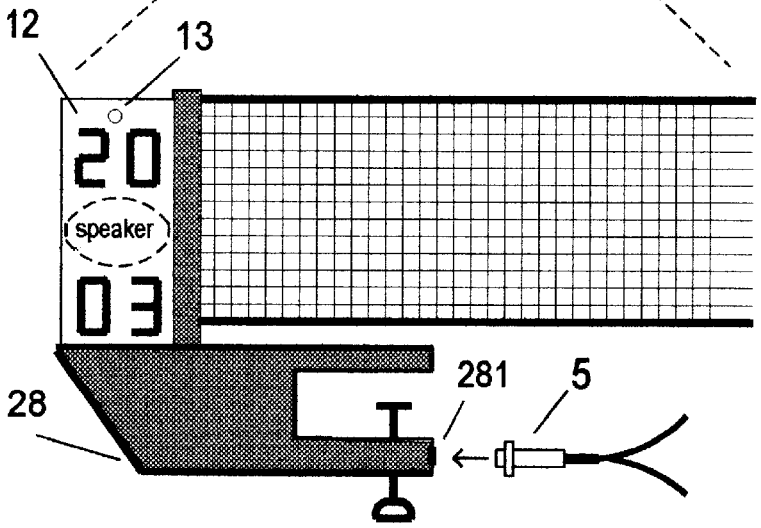
FIGURE 3

FIGURE 4
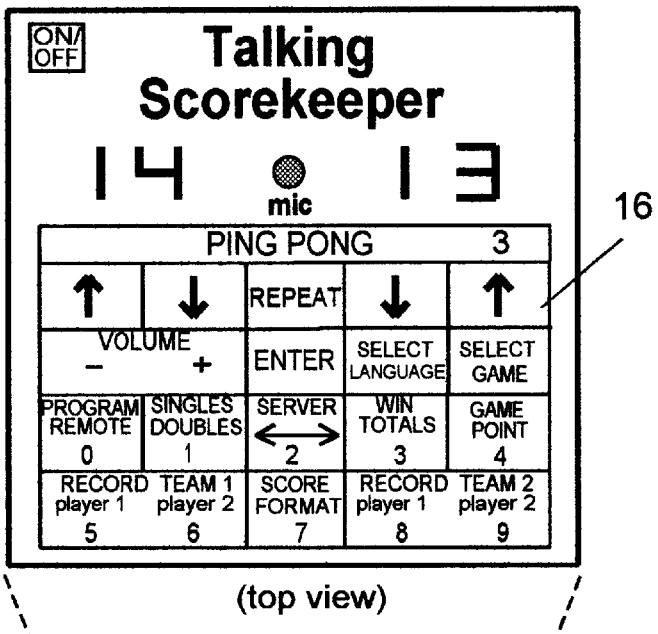
(top view)
FIGURE 5
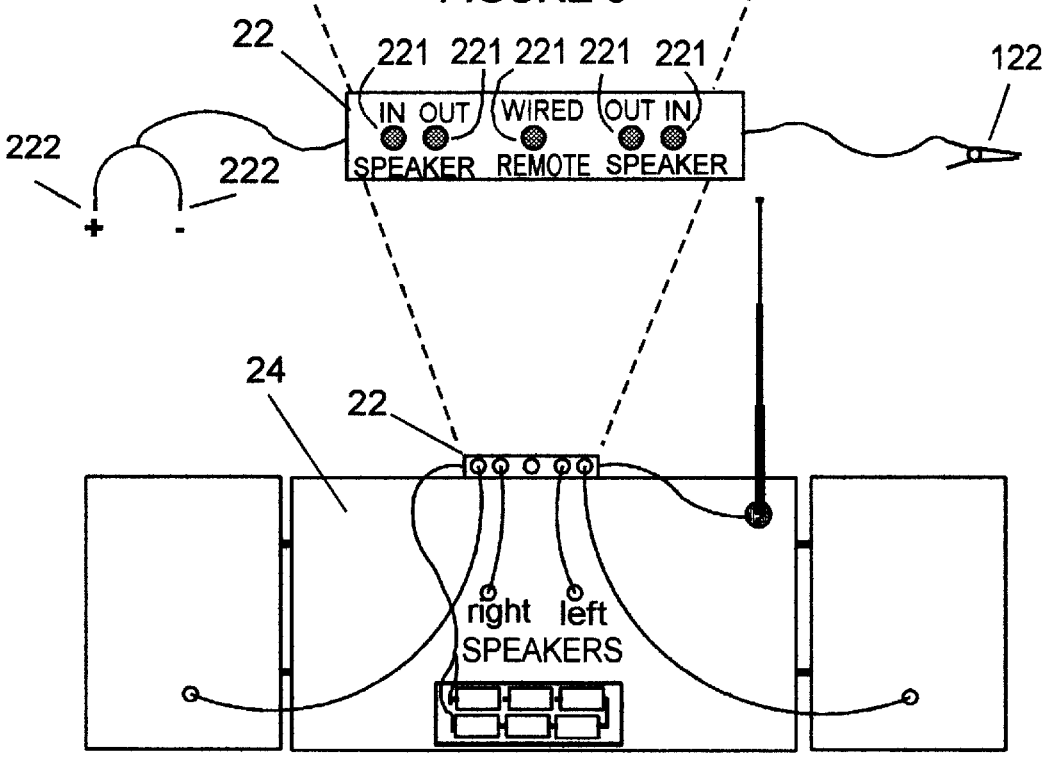
FIGURE 6
(Talking Scorekeeper and music)

FIGURE 7
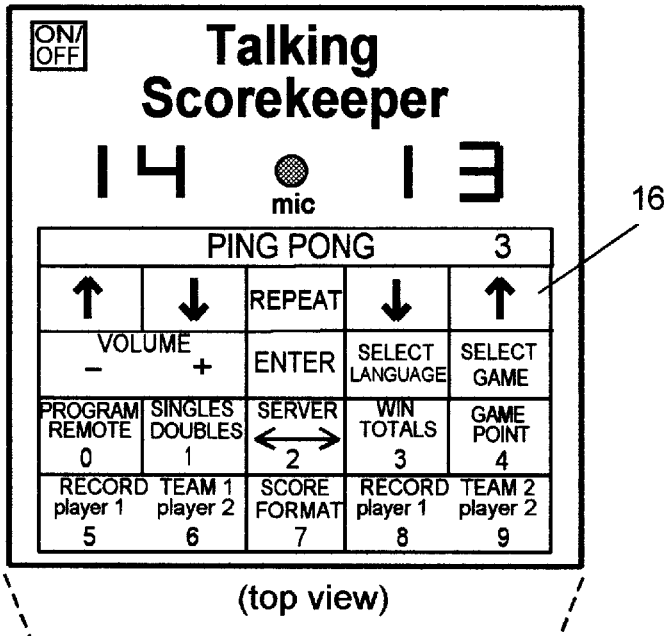
FIGURE 8
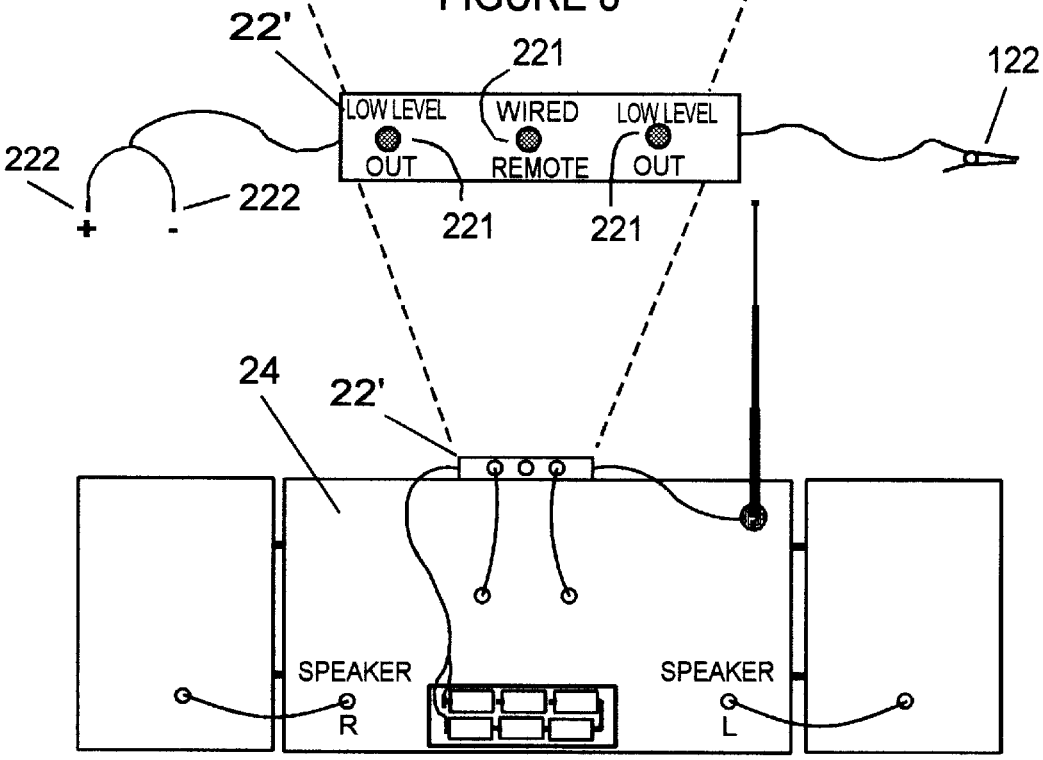
FIGURE 9
(Talking Scorekeeper, no music)

FIGURE 10
(audio only)
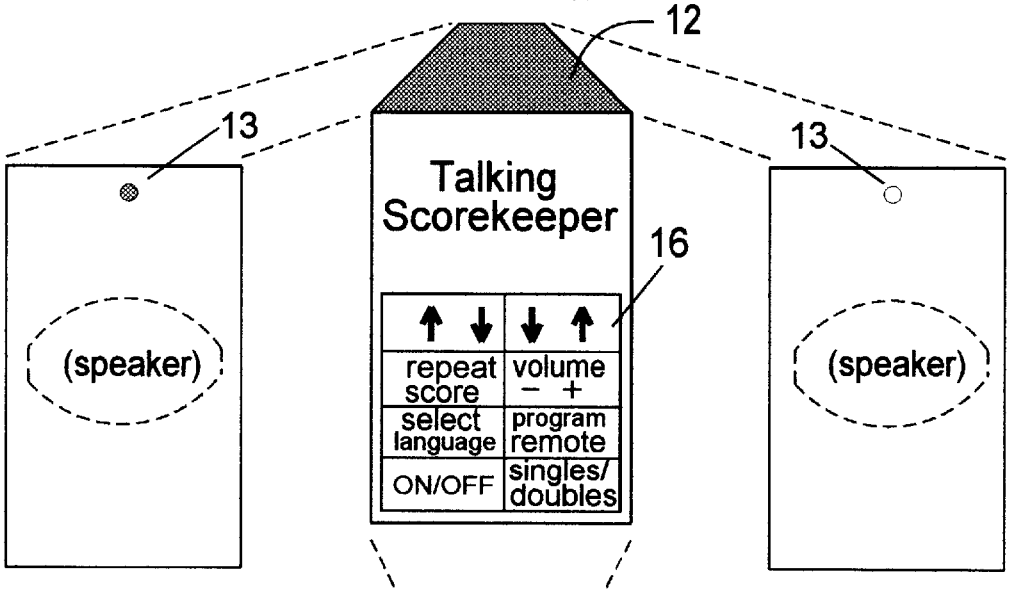
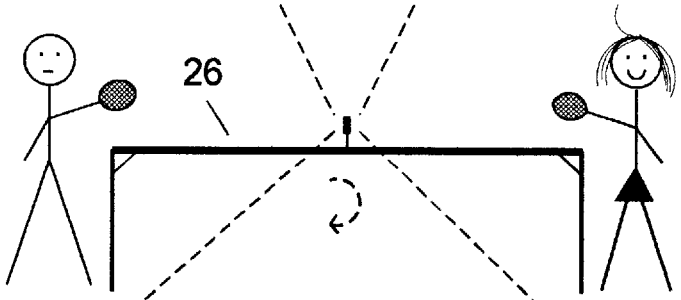
FIGURE 11
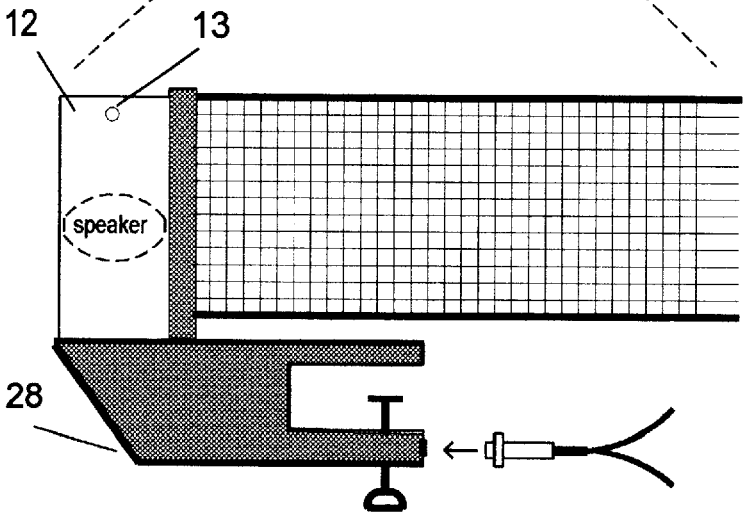
FIGURE 12

(top view)

CONTROL GRID FOR TABLE TENNIS SCOREKEEPING DEVICE WITH AUDIO AND VISUAL DISPLAY

This application is a continuation-in-part of application Ser. No. 08/837,531, filed Apr. 21, 1997 which issued as U.S. Pat. No. 6,012,995 on Jan. 11, 2000. The parent application is to be incorporated by reference in its entirety in this application.

FIELD OF THE INVENTION

The present invention relates generally to scorekeeping devices, and more particularly is a control grid for a "talking scorekeeper" specifically adapted for table tennis, or ping pong.

BACKGROUND OF THE INVENTION

Racket and paddle sports have huge numbers of recreational participants. Some of the more popular racket and paddle sports include tennis, racquetball, badminton, ping pong, etc.

A common problem encountered by recreational players is losing track of the score. Since there is generally no non-participating scorekeeper, the players themselves have to also track the score. This can lead to many problems, given that the players chief focal point is on the playing of the points themselves. Although players are generally required to announce the score before each serve, confusion can be generated by long rallies, when changing servers, or simply in the course of the game itself In addition to honest mistakes in the actual score of a game, a less than sportsmanlike player may intentionally misstate the score.

Disagreements in the score are a common cause of discord in recreational paddle and racket games, and can easily lead to arguments and decreased enjoyment of the game. In the worst case, games may be cancelled because of these disagreements.

Because of the expense of having an impartial scorekeeper, that solution is rarely, if ever, available to the recreational player. Inexpensive score displays are available, but the same problems with confusion of score can arise with these manual devices. It is simply too inconvenient for a player to periodically interrupt the game to update a scoreboard. Similarly, to date there has been no available automated device that has a selling price low enough to make it readily available to the pickup player.

The problem of tracking the score has been addressed by the inventor relative to other sports, e.g. volleyball, in U.S. Pat. No. 5,574,422, the "Multi-Functional Volleyball Talking Scorekeeper", issued Nov. 12, 1996. The present invention addresses specifically the grid used to control the talking scorekeeper adapted specifically for table tennis or ping pong. There are currently no easily activated means of operating a scorekeeping device for ping pong.

Accordingly, it is an object of the present invention to provide a means for automatically keeping score of recreational ping pong games.

It is another object of the present invention to provide a device that is activated by the players' paddles.

It is a further object of the present invention to provide a device that allows play to be continuous.

It is a still further object of the present invention to provide a device that is simple and inexpensive to manufacture.

SUMMARY OF THE INVENTION

The present invention is a control grid for an automated scorekeeping device for table tennis or ping pong. The scorekeeping device includes a voice recorder that is used to announce the score before each serve of the game. The scorekeeping device further includes optional visual displays. The scorekeeping device is actuated by means of a grid system attached to the ends of the table. The grid is activated by the players' touching the grid with a conductive strip affixed to the end of their paddles. The scorekeeper can be adjusted manually to correct mistakes, and can be used in multiple modes.

An advantage of the present invention is that, prior to each serve, the score is audibly announced so that all players can track the score without visual monitoring. This provides a means to assure accurate and honest control of the score, even when the players themselves are responsible for the scorekeeping.

Another advantage of the present invention is that the score of the game can be kept accurately without interrupting the flow of the game.

A further advantage of the present invention is that the scorekeeper is small, lightweight, and easily installed in existing equipment.

A still further advantage of the present invention is that it is inexpensive to manufacture.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 1 shows a talking scorekeeper with visual display adapted for ping pong.

FIG. 2 is a view of the device in use on a ping pong table.

FIG. 3 is a detail view of the ping pong scorekeeper net bracket.

FIG. 4 is a front view of the control panel of the ping pong scorekeeper.

FIG. 5 shows adapting means to connect the scoreboard to an external stereo.

FIG. 6 shows the scoreboard connected to an external stereo in such a manner as to retain the stereo functions.

FIG. 7 is another front view of the control panel of the ping pong scorekeeper.

FIG. 8 shows adapting means to connect the scoreboard to an external stereo.

FIG. 9 shows the scoreboard connected to an external stereo in such a manner as to use only the speaker function of the external stereo.

FIG. 10 shows a ping pong talking scorekeeper with audio announce only.

FIG. 11 is a view of the device in use on a ping pong table.

FIG. 12 is a detail view of the ping pong scorekeeper net bracket.

DETAILED DESCRIPTION OF THE INVENTION

Figure 13:
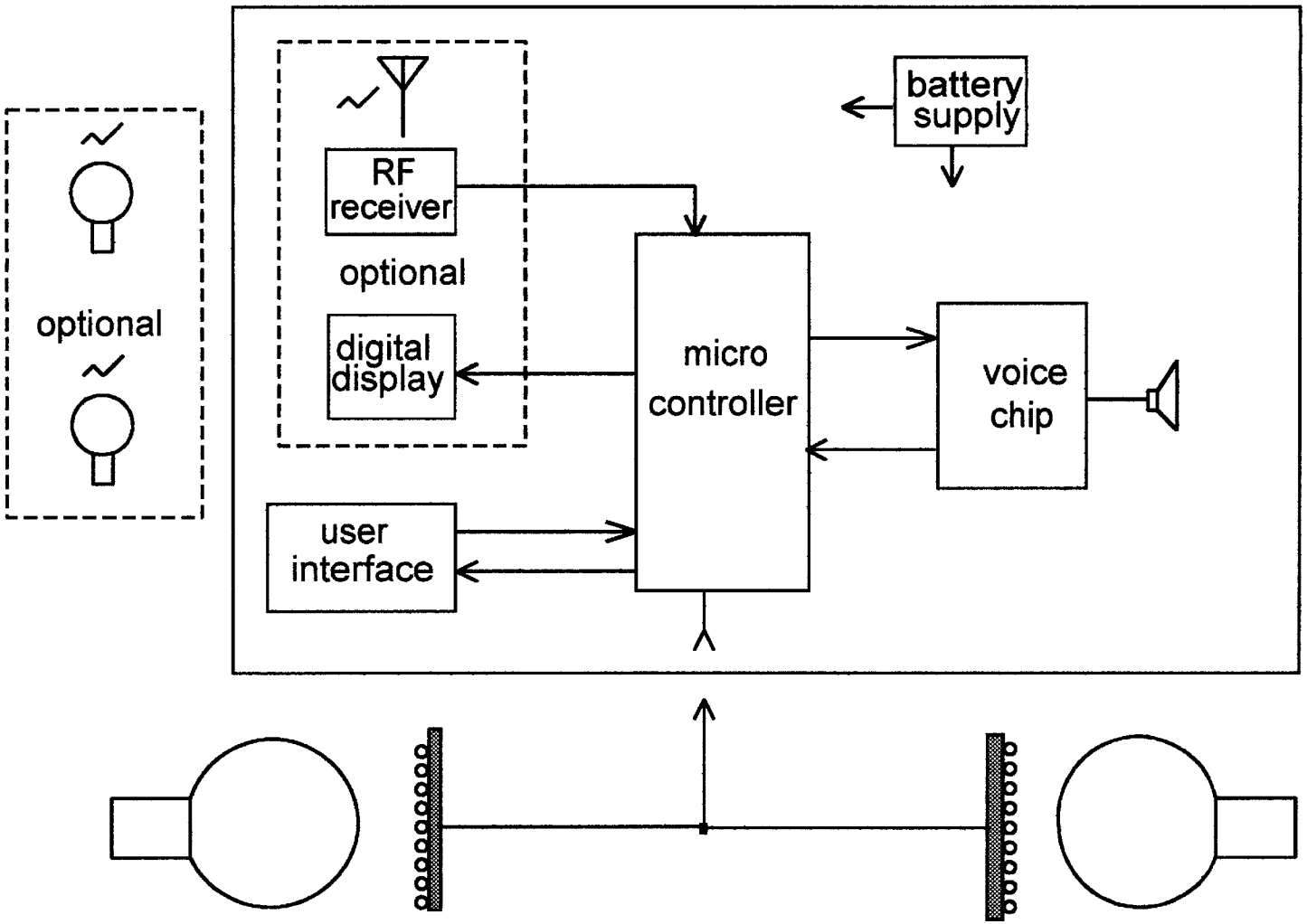
FIG. 13 is a schematic diagram of the ping pong talking scoreboard.

The present invention is a control grid adapted for a ping pong talking scorekeeper. The talking scorekeeper includes means to provide a visual display of the score as well as an audio announcement of the score.

The ping pong talking scorekeeper includes a scoreboard 12 with visual display means 14 on its sides as shown in FIG. 1. The visual display 14 includes a server score display, a receiver score display, and a speaker. The speaker is used to audibly announce the score. An LED serve indicator 13 on the visual display 14 indicates which player is serving.

The scoreboard 12 can be operated by the manual control panel on the front face of the scoreboard 12. The manual control panel will generally only be used during play if a non-participant is keeping score. In addition to the scoring functions, the manual control panel includes a volume control and a language select function if the voice chip is programmed in more than one language.

FIG. 3 shows the scoreboard 12 of the talking scorekeeper constructed as an integral element of a net bracket 28. In this configuration, the net bracket 28 includes an input jack 281 that receives a connection means 5 from the control grid. With the scoreboard 12 as an integral part of the net bracket, the scoreboard 12 is automatically mounted when the net is installed on the table. The scoreboard 12 may also be manufactured as a separate device that is added to a players existing net.

A schematic diagram of the circuitry of the scoreboard 12 is shown in FIG. 13. The microcontroller is operated by either the control grid (described in detail below) or the manual control panel 16. The microcontroller controls the display of the current score on the visual displays 14 of the scoreboard 12. For the audio portion of the scoring, an addressable voice chip is included. The voice chip activates the speakers. Generally, there will be at least one speaker installed in the scoreboard 12. The voice chip is pre-programmed to include all potential scores for both the server and the receiver. A first voice is used for the server's score and a second voice is used for the receiver's score so that there is no chance of mistaking whose score is being announced. For maximum distinguishing of the voices, a male voice and a female voice can be used.

Figure 14:
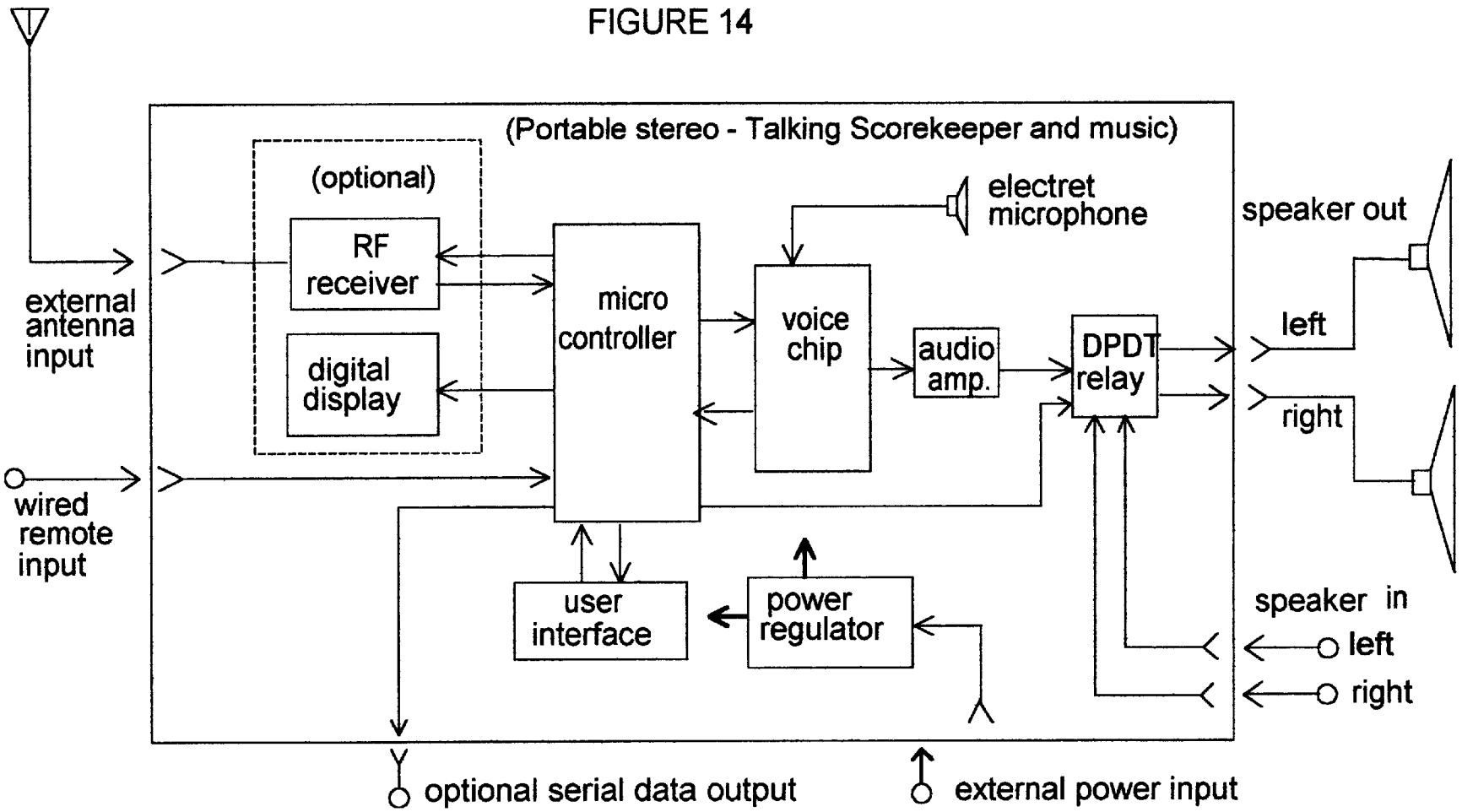
FIG. 14 is a schematic diagram of the ping pong talking scoreboard connected to an external stereo in such a manner as to retain the stereo functions.

FIGS. 4–6 show an adapter means 22 that allows the talking scorekeeper to be wired into a portable stereo system 24. The adapter means 22 includes a plurality of input/output jacks 221 and connectors 222 that are used to connect to the circuitry of the stereo 24. The appropriate wiring connections are indicated in the schematic shown in FIG. 14. In this wiring configuration, the stereo 24 would be shut off only while the talking scorekeeper announces the score. After the score is announced, the stereo feed would resume through the speakers. The portable stereo 24 must have detachable speakers to accommodate this configuration.

Figure 15:
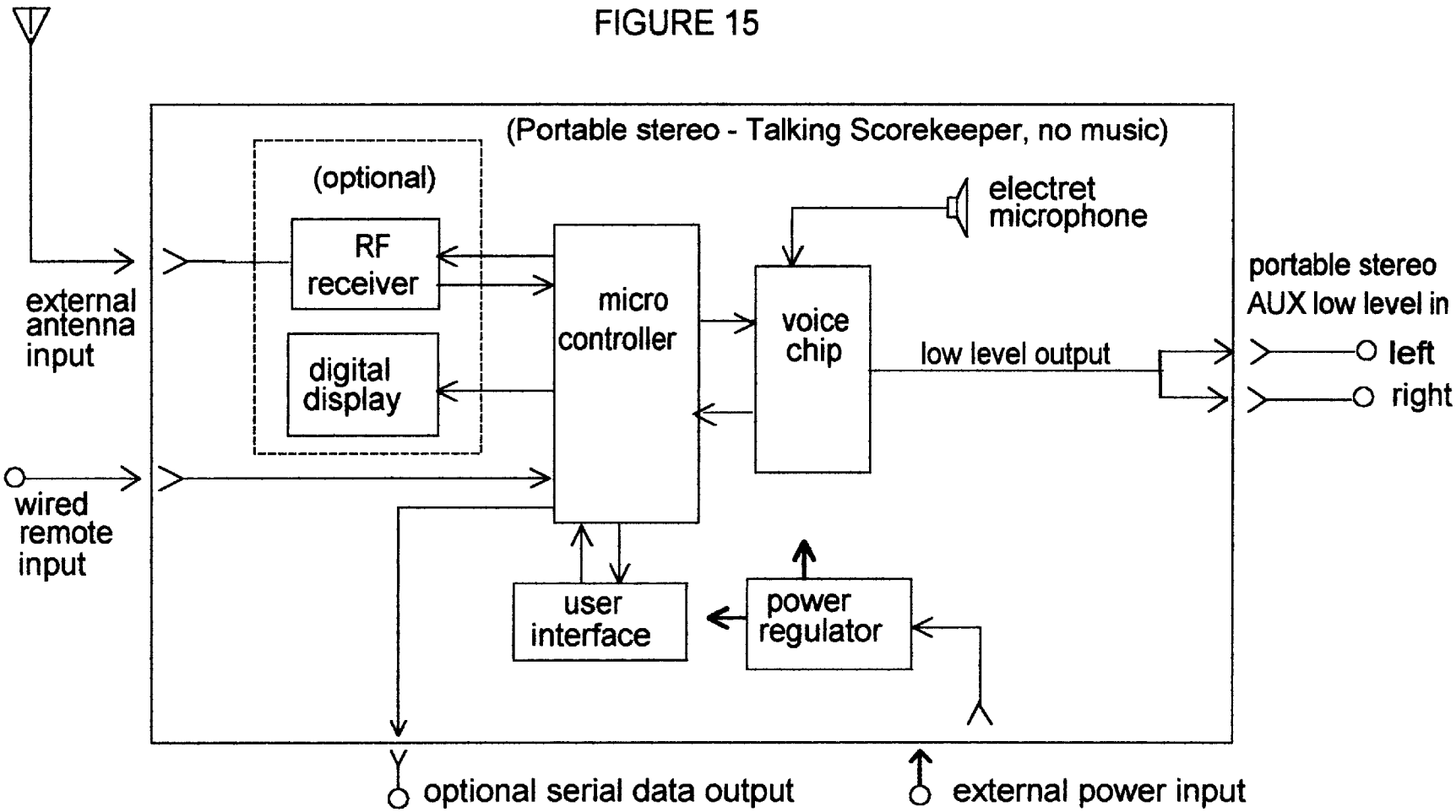
FIG. 15 is a schematic diagram of the ping pong talking scoreboard connected to an external stereo in such a manner as to use only the speaker function of the external stereo.

FIGS. 7–9 show another adapter means 22' that allows the talking scorekeeper to be wired into a portable stereo system 24. The adapter means 22' would only allow the talking scorekeeper to utilize the amplifier and speakers of the stereo. The stereo feed would be disabled in this configuration. The appropriate wiring for this configuration is shown in the schematic in FIG. 15. This configuration does not require detachable speakers.

FIGS. 10–12 show an alternate configuration of the ping pong talking scorekeeper. In this configuration, the talking scorekeeper would not have visual displays, but would operate with self-contained audio output only.

Figure 16:
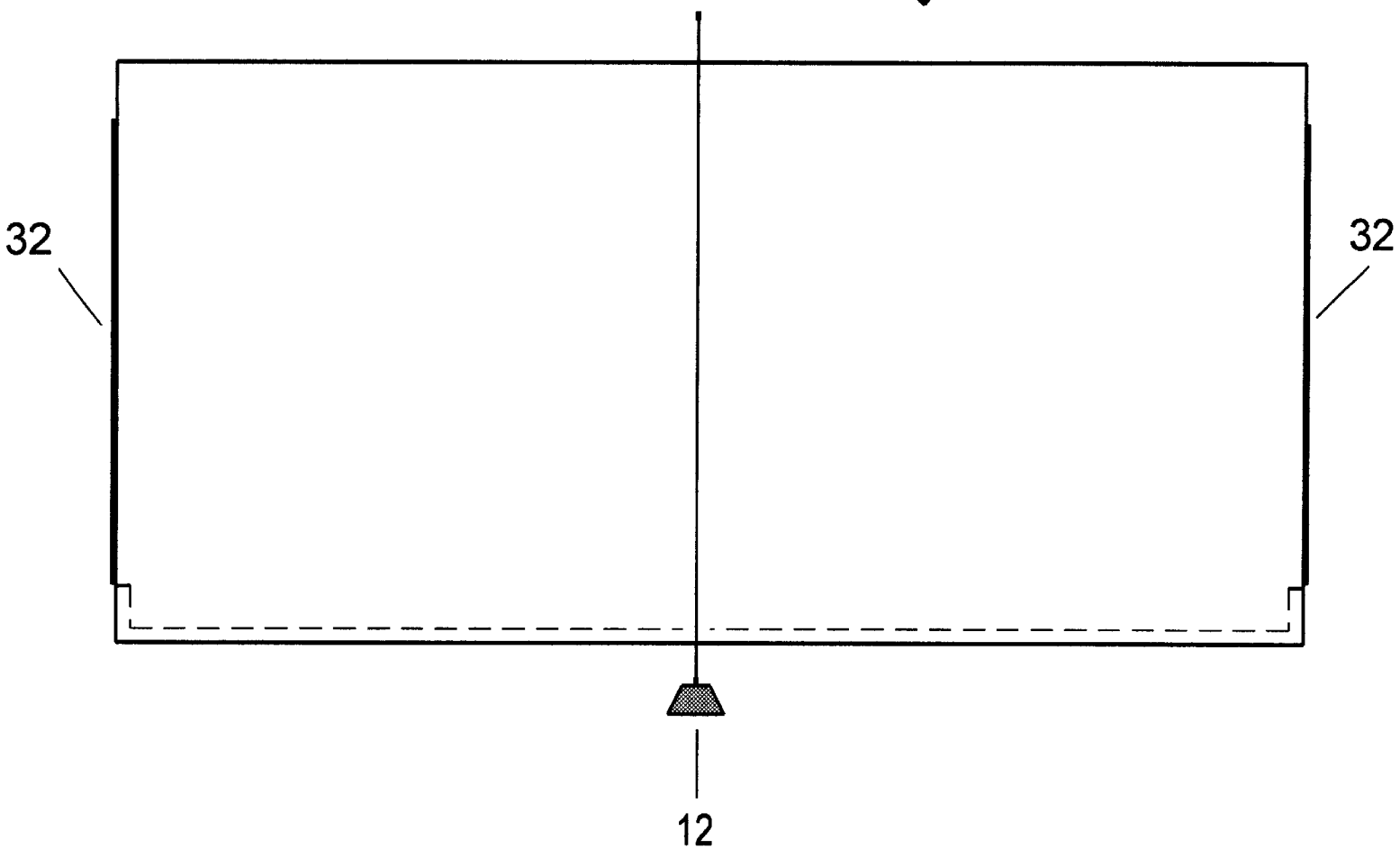
FIG. 16 is an overhead view of the ping pong scorekeeper installed on a ping pong table.
Figure 19:
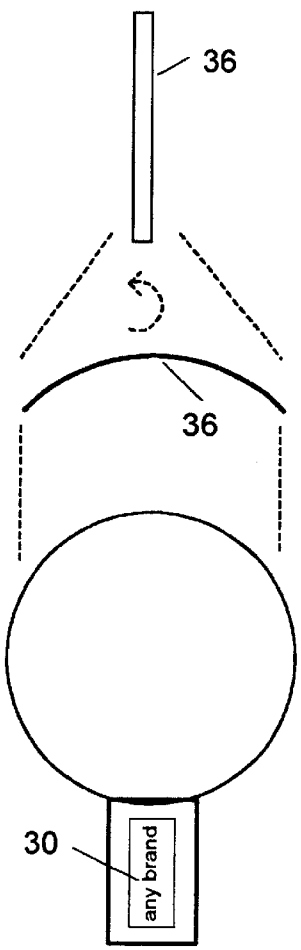
FIG. 19 shows a tape-on metal strip that is added to an existing ping pong paddle.
Figure 17:
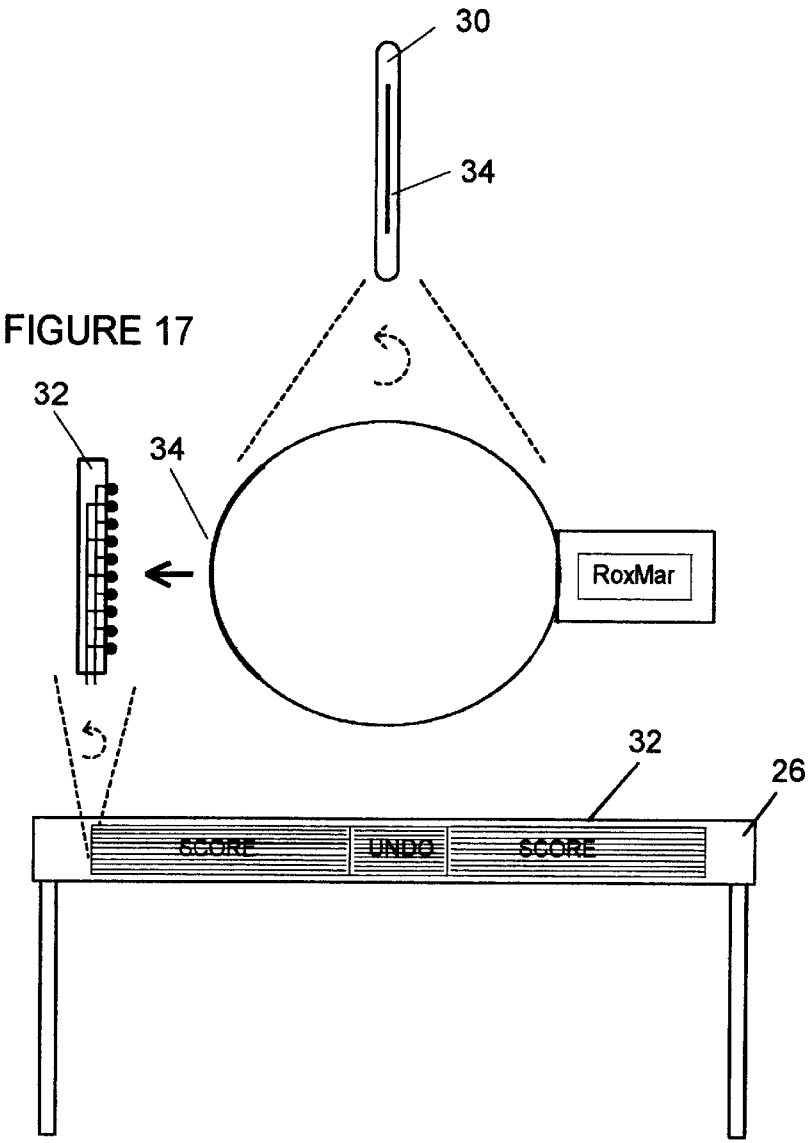
FIG. 17 illustrates how the paddle bridge switch activates the player control grid.
Figure 18:
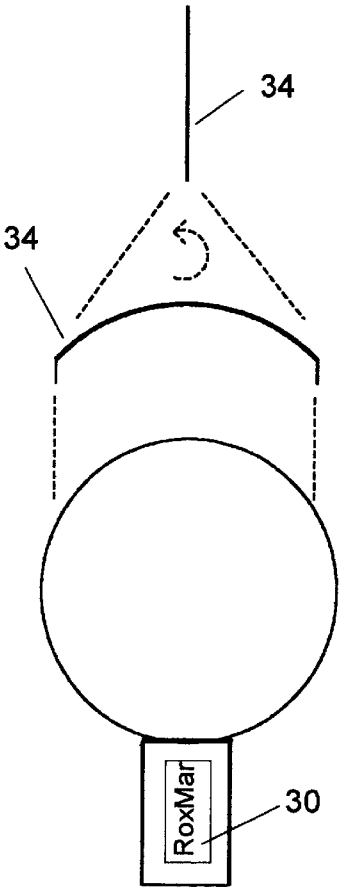
FIG. 18 shows a built-in paddle bridge switch on a ping pong paddle.

The ping pong talking scorekeeper can be operated by remote means as described in Applicant's previous disclosures, or by the manual control panel 16. However, it is envisioned that the talking scorekeeper for ping pong will by far most often be operated by means of a control grid 32 that is installed in the ends of the ping pong table 26 as illustrated in FIG. 16. Referring now to FIGS. 17–19, the control grid 32 is activated by a contact mechanism 34. The contact mechanism 34 is an electrically conductive wire that is affixed to the paddle 30. The contact mechanism 34 may be installed in the paddle 30 during manufacturing of the paddle as shown in FIG. 18. As an alternative construction, the contact mechanism may be a tape-on metal strip 36 that is added to a paddle as an after market item as shown in FIG. 19. The tape-on metal strip 36 is very similar in length, width, and thickness to the blade edge tape currently being used in the market. The tape-on metal strip 36 can be cut to the desired length and width to be best suited for the paddle size being used. Some players, may prefer to cover the entire paddle edge starting and ending at the junction point of the paddle handle. The metal strip could also be attached during the paddle manufacturing process. Players' bodies contacting the grid will have no effect on the scorekeeper, unlike body contact with the typical push button switch used in current art devices.

The control grid 32 itself is comprised generally of a series of parallel conductive elements. The conductive elements can be conductive rods. If rods are used, the control grid 32 must be provided with some flexibility to assure solid contacts. For this reason, when using rods as the conductors, the control grid 32 is mounted on a cushioning backing, generally foam rubber. However, it has been discovered by the inventor that a far more desirable construction, due to manufacturing considerations, is to form the control grid 32 by etching printed circuit board material so as to leave parallel conductive traces. The grid manufactured in this manner is then affixed to the ends of the table 26 by simply using double sided tape or double back foam tape material.

To increment the score using the control grid 32, a player simply touches his paddle 30 to the grid 32 so as to make a connection between any two of the traces of the control grid 32. Making this connection causes the circuitry of the scorekeeper to be activated to update the score. Multiple zones can be defined in the control grid 32, so that different scoring options are available. For instance, with a single zone defined, each player must input only his own points won, and any corrections to the score must be made via the manual control panel 16. For this reason, in many instances, the control grid 32 will be provided with an "undo" region that allows the players to make corrections to the score using their paddles 30 and the control grid 32. Moreover, it might be desired to enable input of both players' scores (for singles), or for all four players for doubles. Some of the more common configurations envisioned for the control grid 32 are depicted in FIGS. 20–27.

Figure 20:
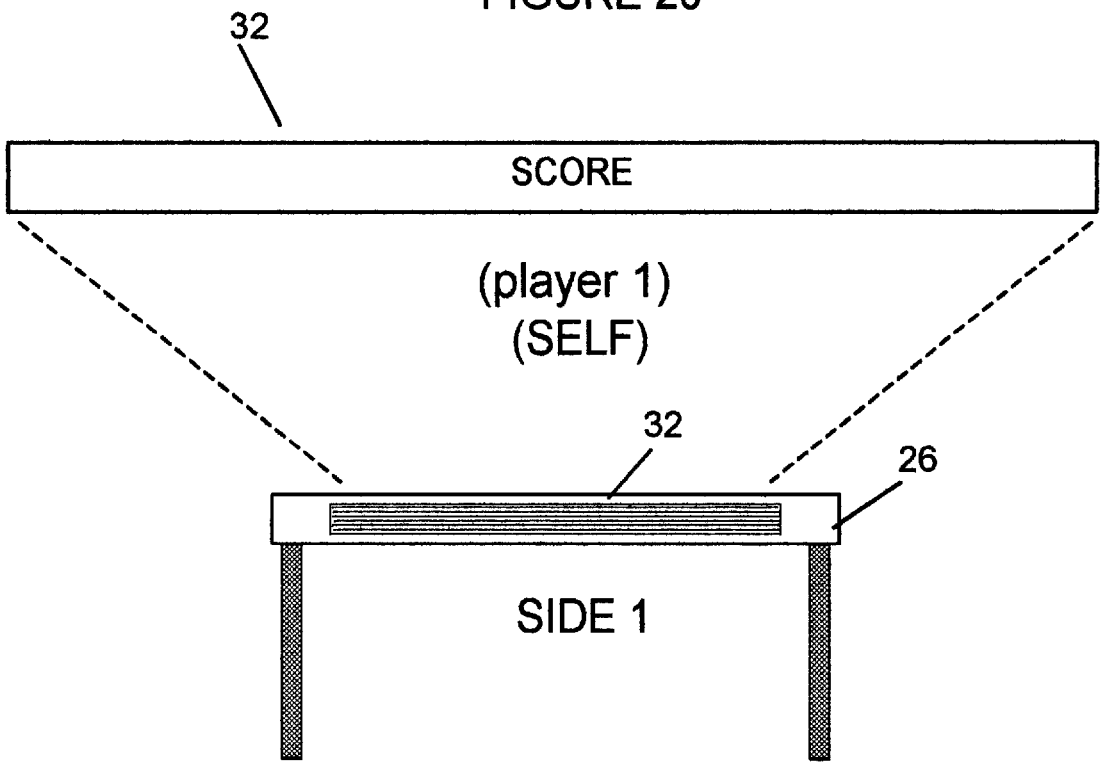
FIG. 20 shows an end view of the ping pong table with a single input zone grid.
Figure 21:
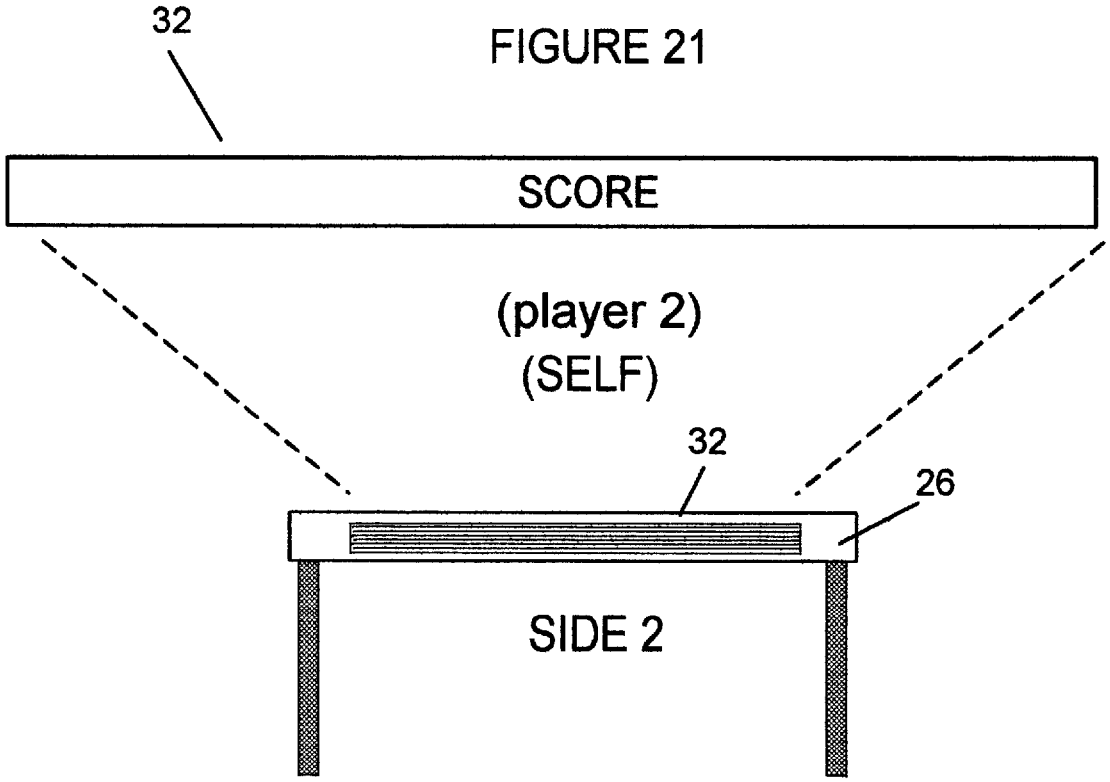
FIG. 21 shows a second player's end view of the ping pong table with a single input zone grid.

In the configuration shown in FIGS. 20–21, a single input control grid 32 is utilized. This configuration provides both players with easy access to the scorekeeper, as the control grid 32 can cover the entire end of the table, there being no areas designated for other inputs. Each player must input his own points won, and any corrections must be made on the manual control panel 16. This configuration is the most simple and easiest to manufacture. It should be noted that the control grid 32 may be manufactured as part of a table 26, or as an add-on item that is sold in the after market.

Figure 22:
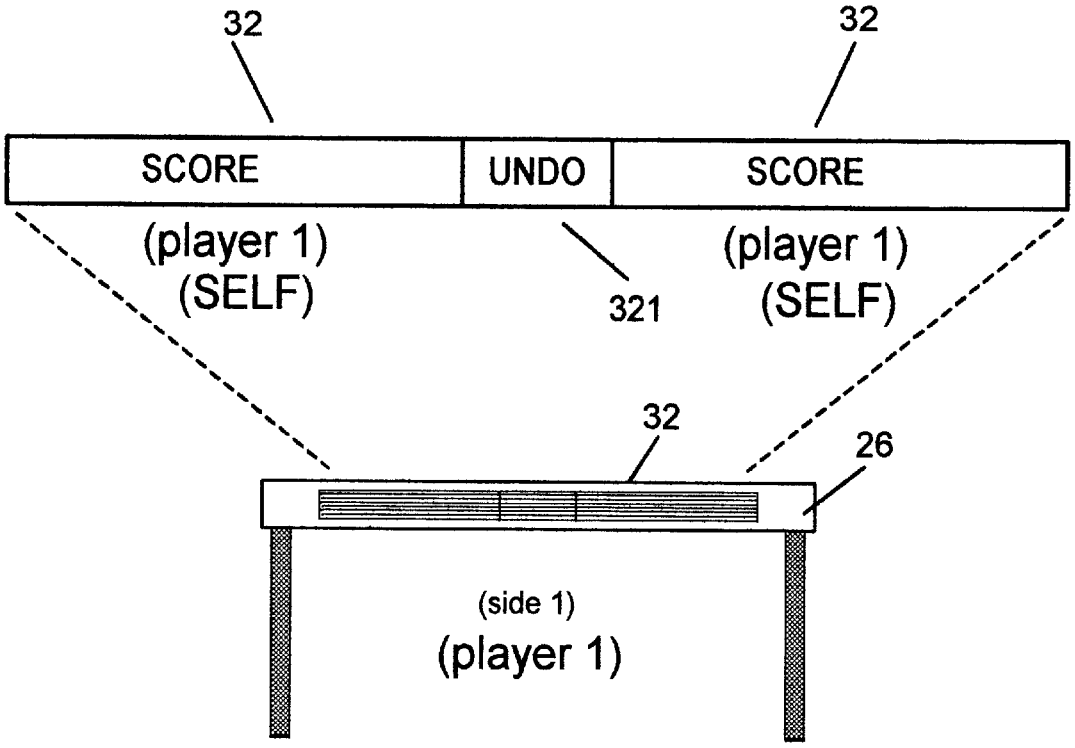
FIG. 22 shows an end view of the ping pong table with an undo function.
Figure 23:
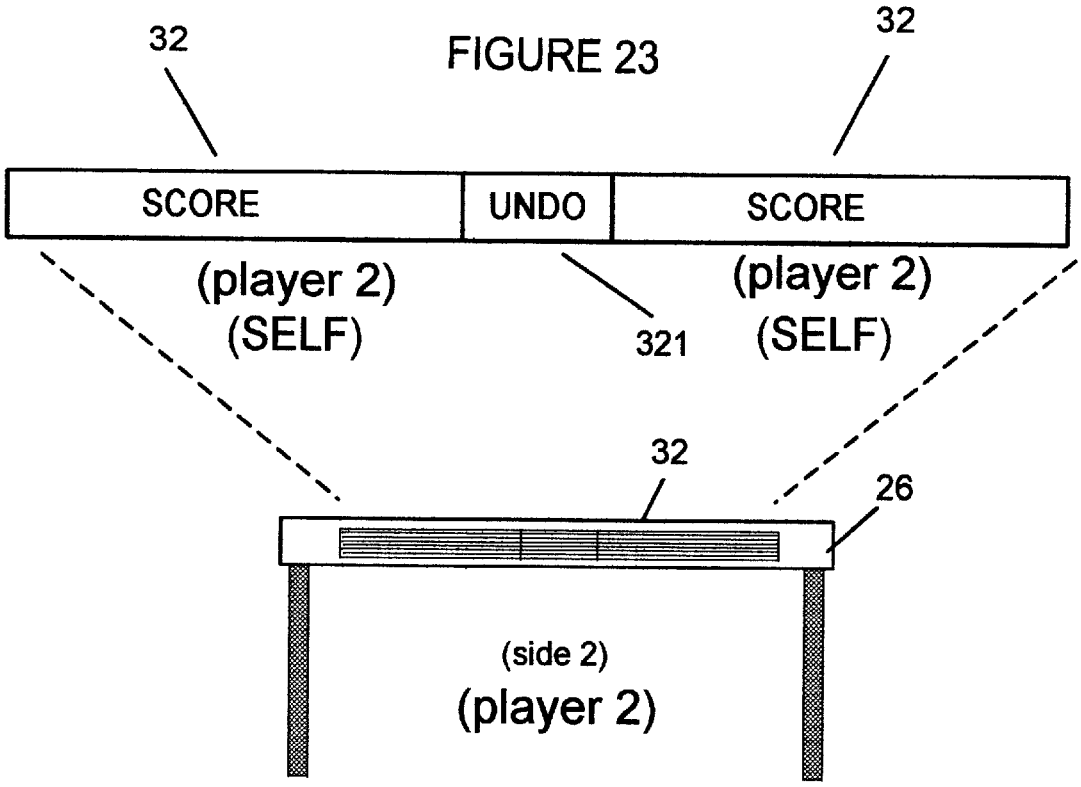
FIG. 23 a second player's end view of the ping pong table with an undo function.

FIGS. 22–23 show a control grid 32 with an undo area 321. The undo area 321 enables the player to reverse the previous score input by making a contact with the contact mechanism 34 of their paddle 30 on the undo region 321. The undo region 321 will generally be kept fairly narrow, about one inch, so that unintentional contacts are not made. However, the one inch width allows the player to easily contact the undo are 321 when they so desire.

Figure 24:
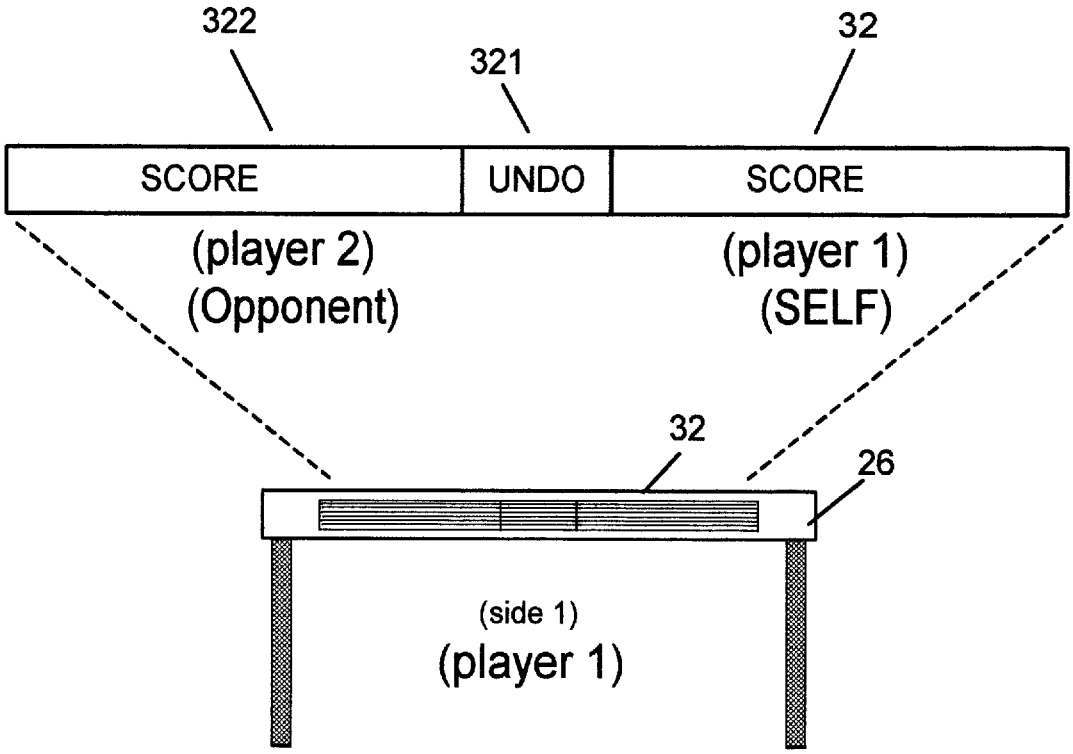
FIG. 24 shows an end view of the ping pong table with a two-player input grid and an undo function.
Figure 25:
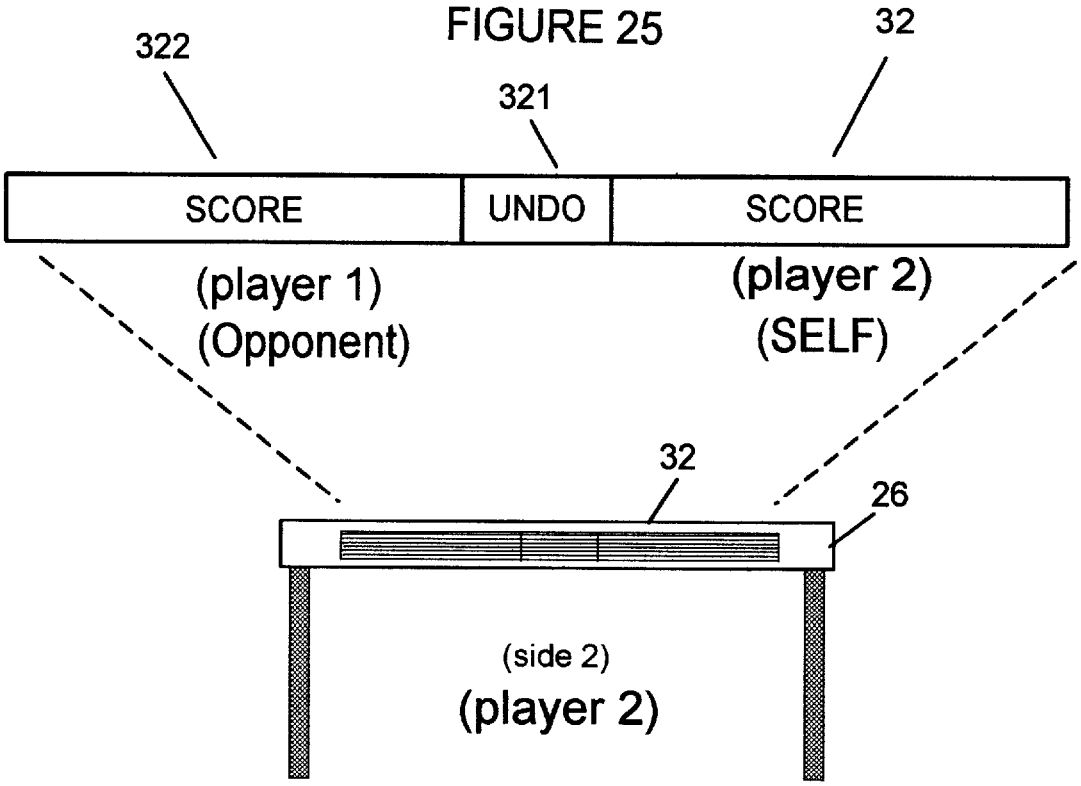
FIG. 25 shows a second player's end view of the ping pong table with a two-player input grid and an undo function.

FIGS. 24–25 show a configuration that includes the undo area 321, and also includes an area that controls the opponent's score, a second scoring area 322. Touching the control grid 32 allows the player to change his own score, and contacting the second scoring region 322 allows the player to change his opponent's score. If desired by the user, a lockout mechanism can be provided so that only the server can modify the score.

Figure 26:
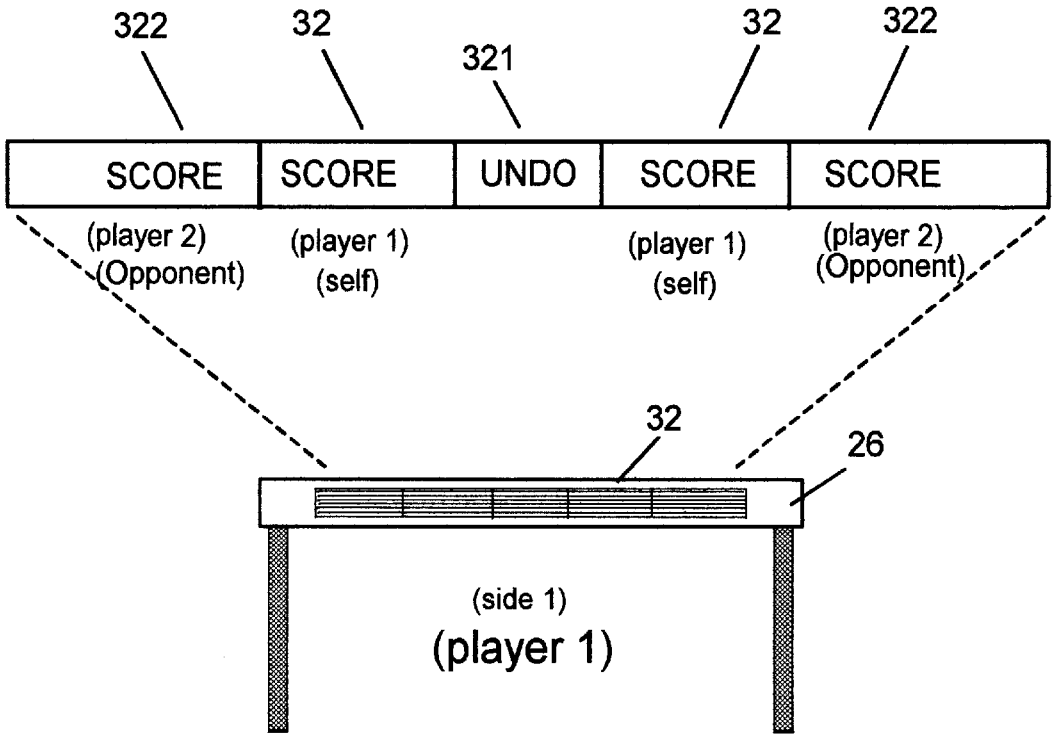
FIG. 26 shows an end view of the ping pong table with a two-player input grid, opponent score input, and an undo function.
Figure 27:
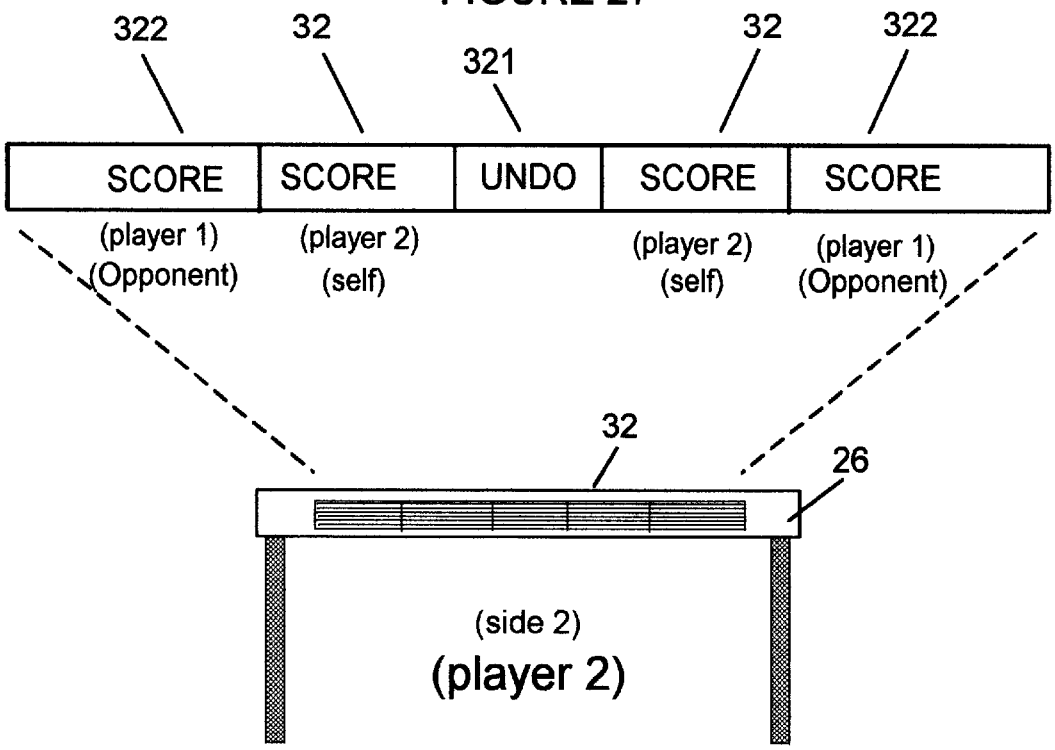
FIG. 27 shows a second player's end view of the ping pong table with a two-player input grid, opponent score input, and an undo function.

FIGS. 26–27 show a control grid adapted for doubles play. In this configuration, the first and second scoring regions are duplicated on each side of the table, so that each of the control areas are present on a given half of an end of the table 26. This configuration is the most convenient to use, as it enables doubles teams to easily operate the scoreboard, and equally facilitates use by both right- and left-handed singles players. Again, if desired by the user, a lockout mechanism can be provided so that only the server (or serving team) can modify the score.

Use of the ping pong talking scorekeeper for singles play would be as follows:

After it has been determined who will serve first, that first player contacts the control grid 32. The scorekeeper announces "Begin new game, zero serving zero." The voice output used by the scorekeeper is changed from a first voice for the first player serving to a second voice when the second player is serving. The voices alternate after each five points served so as to alternate with the proper server. After each five points, the scorekeeper announces "Rotate serve," followed by the score. The "Rotate serve" announcement precedes the score so that errors in the person serving can be avoided.

To assure that the points are input properly, points input by the server or receiver in grid zone 32 (self score) will cause the scorekeeper to emit a short tone immediately preceding announcement of the score. These audio cues allow the non-scorekeeping player to monitor the score without having to avert his visual focus, thereby improving his concentration on the game.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A control grid used in combination with Ping Pong equipment including a scorekeeping device comprising:

a plurality of parallel conductive elements, said conductive elements are mounted on an end of a Ping Pong table, and said control grid is actuated by a triggering mechanism installed in a Ping Pong paddle; wherein said triggering mechanism comprises an electrically conductive material that is adapted to be affixed to an end of the Ping Pong paddle; such that the scorekeeping device is operated by a player making an electrically conductive connection between said triggering mechanism and said control grid, such that the score of the game is changed by the player placing the paddle in a position that causes said triggering mechanism to make an electrical connection with said control grid.

2. The control grid of claim 1 wherein:

said plurality of parallel conductive elements are formed by etching printed circuit board material so as to leave parallel conductive traces.

3. The control grid of claim 1 wherein:

said plurality of parallel conductive elements are conductive rods mounted on a flexible backing.

4. The control grid of claim 1 wherein:

an undo region is defined in said control grid.

5. The control grid of claim 1 wherein:

a first scoring region and a second scoring region are defined in said control grid, said first scoring regions controls a first player's score, and said second scoring region controls a second player's score.

6. The control grid of claim 5 wherein:

said first and said second scoring regions are divided into two sections, a first section being on a right side of an end of the table, and a second section being on a left side of an end of the table, such that both the left side and the right side of the end of the table include activating areas for said first and said second scoring regions.

7. The control grid of claim 1 wherein:

said control grid on a receiver's end of the table is disabled during play so that the receiver does not inadvertently input scored points to the scorekeeping device.

* * * * *